US008651304B2

(12) United States Patent
Skillin et al.

(10) Patent No.: US 8,651,304 B2
(45) Date of Patent: Feb. 18, 2014

(54) DISPENSING CLOSURE

(75) Inventors: Clifford Skillin, Blackstone, MA (US); Patrick Brannon, Warwick, RI (US)

(73) Assignee: MWV Slatersville, LLC, Slatersville, RI (US)

( * ) Notice: Subject to any disclaimer, the term of this patent is extended or adjusted under 35 U.S.C. 154(b) by 0 days.

(21) Appl. No.: 13/820,785

(22) PCT Filed: Jun. 7, 2012

(86) PCT No.: PCT/US2012/041417

§ 371 (c)(1), (2), (4) Date: Mar. 5, 2013

(87) PCT Pub. No.: WO2012/170731

PCT Pub. Date: Dec. 13, 2012

(65) Prior Publication Data

US 2013/0161281 A1 Jun. 27, 2013

Related U.S. Application Data

(60) Provisional application No. 61/494,429, filed on Jun. 8, 2011.

(51) Int. Cl.
*B67D 99/00* (2010.01)
*B65D 55/00* (2006.01)

(52) U.S. Cl.
USPC ..... 215/219; 215/228; 141/381; 222/109

(58) Field of Classification Search
USPC ..... 222/108, 109, 111, 566, 571; 215/219, 215/228, DIG. 7; 141/381, 311 R, 369, 379, 141/380, 392
See application file for complete search history.

(56) References Cited

U.S. PATENT DOCUMENTS

| | | | |
|---|---|---|---|
| 817,465 | A | 4/1906 | Bragg |
| 2,817,465 | A | 12/1957 | Gray |
| 2,920,799 | A | 1/1960 | Binder |

(Continued)

FOREIGN PATENT DOCUMENTS

| | | | |
|---|---|---|---|
| DE | 8431343 | U1 | 4/1985 |
| EP | 0109704 | A1 | 5/1994 |
| JP | 56024461 | U | 3/1981 |
| JP | 2004210354 | A | 7/2004 |

*Primary Examiner* — Mickey Yu
*Assistant Examiner* — Niki Eloshway
(74) *Attorney, Agent, or Firm* — Barlow, Josephs & Holmes, Ltd.

(57) ABSTRACT

A dispensing closure (10) for dispensing a product from a container (12) includes a cup base (14) and a measuring cup (16). The cup base (14) has an inner skirt (15) configured and arranged to engage a neck (28) of the container (12) and the measuring cup (16). An outer skirt (18) of the cup base (14) has at least one or more latch hook members (30A, 30B) to engage the measuring cup (16). The outer skirt (18) has at least one or more latch hook areas (32A, 32B) configured to disengage the at least one or more latch hook members (30A, 30B). The measuring cup (16) has a stepped shoulder (42A) for engaging the at least one or more latch hook members (30A, 30B) of the cup base (14). In operation, a force is applied to the one or more latch hook areas (32A, 32B) to disengage the one or more latch hook members (30A, 30B) from the stepped shoulder (42A) which permits removal of the measuring cup (16) from the cup base (14).

15 Claims, 19 Drawing Sheets

(56) References Cited

U.S. PATENT DOCUMENTS

| | | | | | |
|---|---|---|---|---|---|
| 3,059,822 | A | | 10/1962 | Eisendath et al. | |
| 4,310,105 | A | | 1/1982 | Gach | |
| 4,416,381 | A | | 11/1983 | Swartwout | |
| 4,550,862 | A | | 11/1985 | Barker et al. | |
| 4,566,508 | A | | 1/1986 | Bowyer | |
| 4,629,081 | A | | 12/1986 | McLaren | |
| 4,834,251 | A | | 5/1989 | Yu | |
| 4,917,268 | A | * | 4/1990 | Campbell et al. | 222/109 |
| 4,948,002 | A | | 8/1990 | Thornock et al. | |
| 4,974,749 | A | * | 12/1990 | Mon | 222/111 |
| 4,984,714 | A | | 1/1991 | Sledge | |
| 5,060,827 | A | | 10/1991 | Segati | |
| 5,078,288 | A | | 1/1992 | Fuchs | |
| 5,108,009 | A | * | 4/1992 | Davidson et al. | 222/109 |
| 5,251,788 | A | | 10/1993 | Moore | |
| 5,433,338 | A | | 7/1995 | Proshan | |
| 5,435,467 | A | | 7/1995 | Ekkert et al. | |
| 5,529,202 | A | | 6/1996 | Shamis | |
| 5,727,703 | A | | 3/1998 | Fuchs | |
| 5,765,705 | A | | 6/1998 | Deubel | |
| 5,794,803 | A | | 8/1998 | Sprick | |
| 5,941,422 | A | * | 8/1999 | Struble | 222/109 |
| 6,032,829 | A | | 3/2000 | Geisinger et al. | |
| 6,036,036 | A | | 3/2000 | Bilani et al. | |
| 6,168,035 | B1 | | 1/2001 | McLelland | |
| 6,223,946 | B1 | | 5/2001 | Geisinger et al. | |
| 6,398,076 | B1 | | 6/2002 | Giblin et al. | |
| 6,464,106 | B1 | * | 10/2002 | Giblin et al. | 222/109 |
| 6,622,615 | B2 | | 9/2003 | Heczko | |
| 6,848,484 | B1 | | 2/2005 | Darr | |
| 6,866,164 | B2 | | 3/2005 | Branson et al. | |
| 6,964,359 | B1 | * | 11/2005 | Darr et al. | 222/570 |
| D515,419 | S | | 2/2006 | Manke | |
| 7,128,227 | B2 | | 10/2006 | Skillin et al. | |
| 7,207,466 | B2 | | 4/2007 | Walsh et al. | |
| 7,296,700 | B2 | | 11/2007 | Steele, IV et al. | |
| 7,520,410 | B2 | | 4/2009 | Gilbertson et al. | |
| 7,673,774 | B2 | | 3/2010 | Molloy et al. | |
| 7,686,188 | B2 | | 3/2010 | Stebick et al. | |
| 7,841,489 | B2 | | 11/2010 | Gilbertson et al. | |
| 7,959,034 | B2 | | 6/2011 | Faaborg et al. | |
| 7,980,403 | B2 | | 7/2011 | Martinez | |
| 8,011,535 | B2 | | 9/2011 | Tauber et al. | |
| 8,025,183 | B2 | | 9/2011 | Szekely et al. | |
| 8,523,024 | B2 | * | 9/2013 | Piscopo et al. | 222/568 |
| 2004/0182814 | A1 | | 9/2004 | Suffa | |
| 2005/0039821 | A1 | * | 2/2005 | Darr | 141/381 |
| 2005/0103803 | A1 | * | 5/2005 | Hung et al. | 222/109 |
| 2007/0194047 | A1 | | 8/2007 | Tauber et al. | |
| 2009/0045224 | A1 | | 2/2009 | Faaborg et al. | |
| 2010/0116776 | A1 | | 5/2010 | Szekely | |
| 2010/0243598 | A1 | | 9/2010 | Straughan | |
| 2010/0320168 | A1 | | 12/2010 | Bull | |
| 2011/0204099 | A1 | | 8/2011 | Piscopo et al. | |
| 2012/0012613 | A1 | * | 1/2012 | Tauber et al. | 222/109 |

* cited by examiner

DISPENSING CLOSURE

BACKGROUND

The present disclosure relates to container closures, and more particularly to dispensing closures for dispensing a product having a "squeeze and turn" child-resistant feature.

SUMMARY

A first exemplary embodiment of a dispensing closure in accordance with the teachings herein is operable for dispensing a product from a container. The product, in one embodiment, may be a liquid product. The dispensing closure for dispensing a product from a container includes a cup base and a measuring cup.

The cup base has an inner skirt, an outer skirt and a deck. The deck defines a dispensing aperture to allow a flow of product from the container. In one embodiment, a spout surrounds the dispensing aperture and depends from the deck. The spout may be integrally formed with the deck. The spout has a diameter which is greater than the diameter of the dispensing aperture.

A liner may be disposed proximal to the dispensing aperture. In one embodiment, the liner may be removably attached proximal to the dispensing aperture. The liner may also be attached to a liner shelf or bead positioned on an inner diameter of the spout.

The inner skirt depends from the deck and has an upper portion and a lower portion. The lower portion of the inner skirt is configured and arranged to engage a neck of the container. In one embodiment, the lower portion of the inner skirt has at least one or more threads extending inwardly for threadably engaging one or more threads on the neck of the container.

The lower portion of the inner skirt also defines a cutout for engaging an orientation lug on the neck of the container to facilitate proper orientation of the cup base to the product container. The lower portion of the inner skirt further has a thread stop lug located proximal to the cutout to prevent removal of the cup base from the neck of the container.

The upper portion of the inner skirt configured and arranged to engage a measuring cup. In one embodiment, the upper portion of the inner skirt has at least one or more threads for threadably engaging the measuring cup.

The outer skirt depends from the deck and has an upper portion and a lower portion. The upper portion of the outer skirt has at least one or more latch hook members to engage the measuring cup. The lower portion of the outer skirt has at least one or more latch hook areas configured to disengage the at least one or more latch hook members from the measuring cup upon application of force to the one or more latch hook areas.

The measuring cup has a stepped inner diameter. The measuring cup includes a measuring cup body, an inner measuring cup skirt, and an outer measuring cup skirt. In one embodiment, the measuring cup body has measuring indicia located on an inner surface to facilitate measuring of product. An outer surface of the outer measuring cup skirt has a stepped shoulder for engaging the at least one or more latch hook members of the cup base. An inner surface of the outer measuring cup skirt having one or more threads extending inwardly for engaging the one or more thread of the upper portion of the inner skirt.

The dispensing closure, in one embodiment, has a distance between the inner skirt and the outer skirt of the cup base which is configured to receive the outer measuring cup skirt of the measuring cup. In another embodiment, a diameter of the inner measuring cup skirt is less than the diameter of the inner skit of the cup base. Also, the diameter of the outer measuring cup skirt is less than the diameter of the outer skirt of the cup base.

The embodiment includes a combination of both "squeeze and turn" CR features and threadably removing the measuring cup from the cup base. In operation, in order for a user to disengage the CR feature of measuring cup and the cup base, the user must squeeze latch hook areas of the cup base under the latch hook members to disengage the latch hook members from the stepped shoulder of the outer measuring cup skirt. Thereafter, after the disengagement of the CR feature, the measuring cup is permitted to be threadably removed from the cup base.

Objectives, features and advantages of the embodiments shall become apparent as the description thereof proceeds when considered in connection with the accompanying illustrative drawings.

BRIEF DESCRIPTION OF THE DRAWING FIGURES

In the drawings which illustrate several exemplary modes for carrying out the present invention:

DETAILED DESCRIPTION OF A PREFERRED EMBODIMENT

Figure 1:
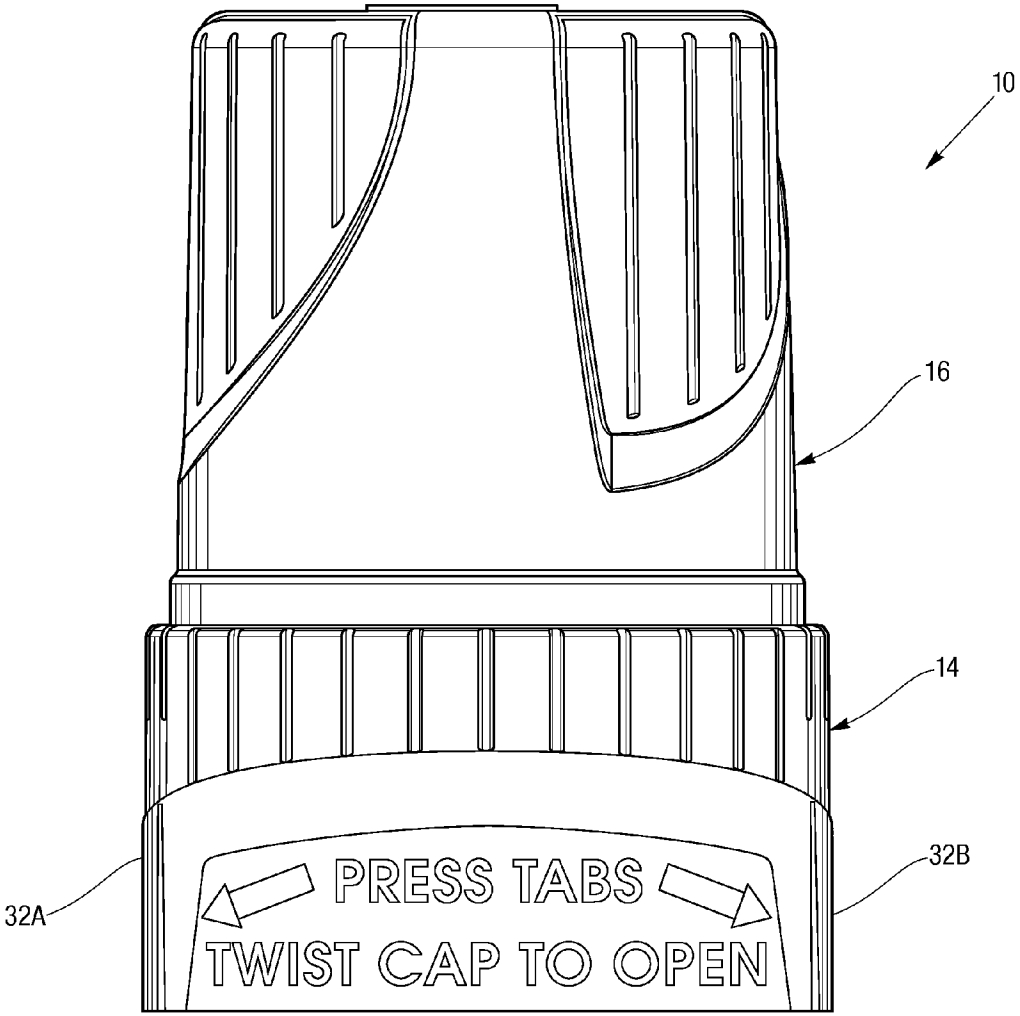
FIG. 1 is a side view of a first exemplary embodiment of the dispensing closure including the measuring cup and the cup base.
Figure 2:
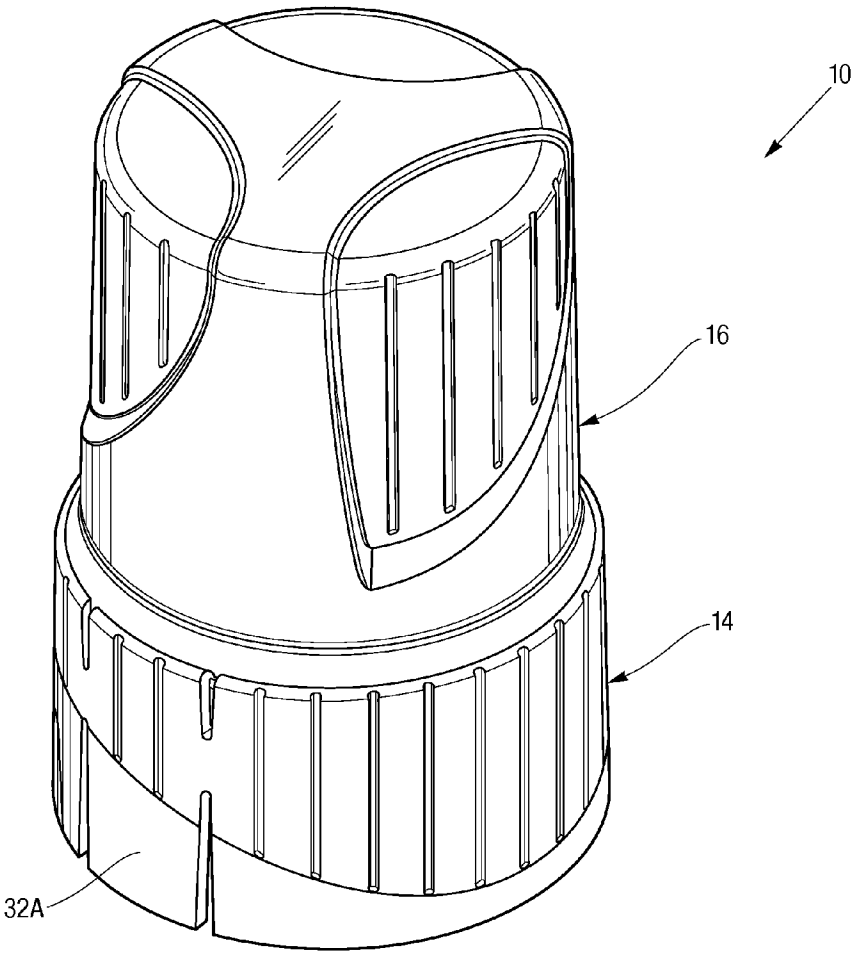
FIG. 2 is an isometric view of the dispensing closure of FIG. 1.
Figure 3:
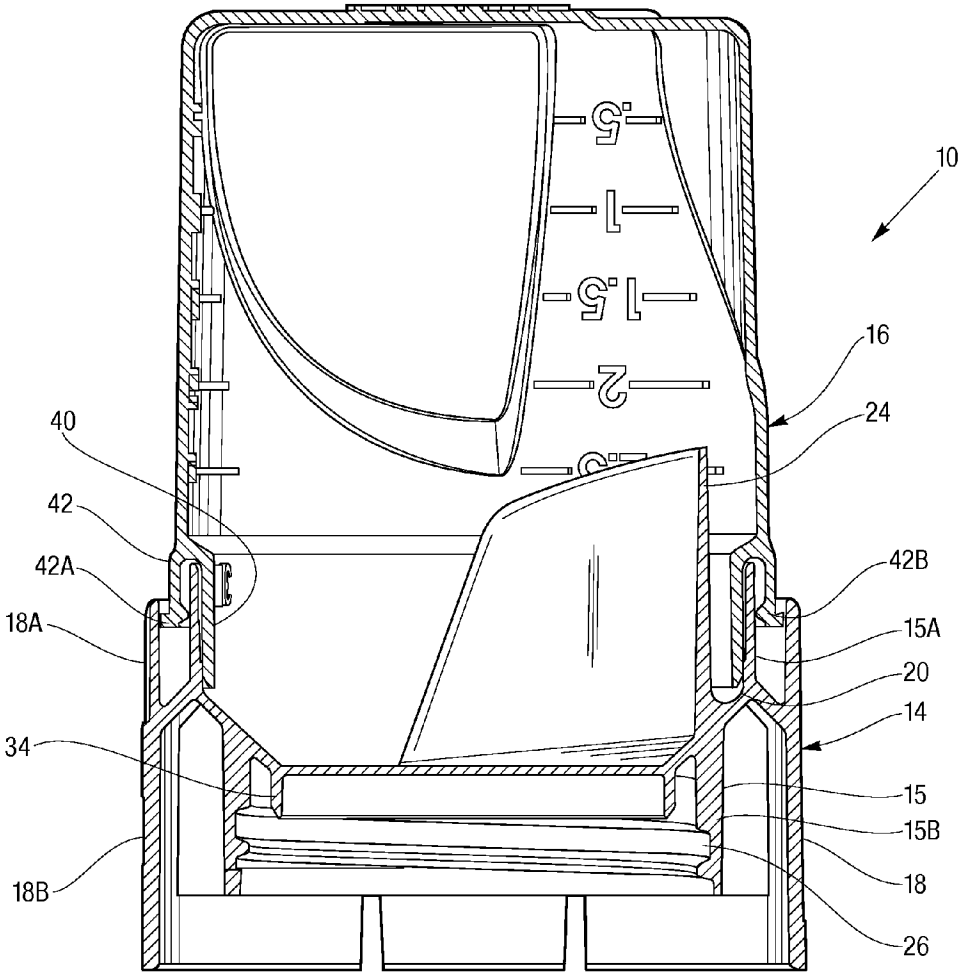
FIG. 3 is a cross-sectional view of the dispensing closure of FIG. 1.
Figure 4:
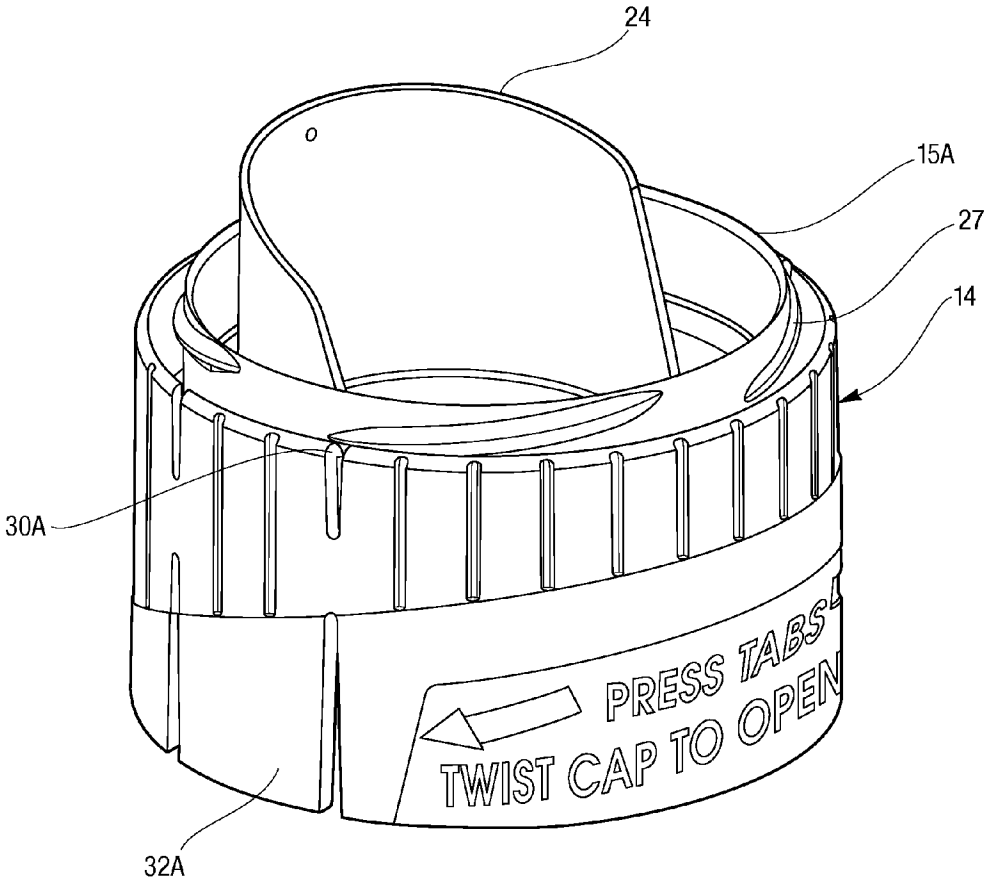
FIG. 4 is rear perspective view of the cup base of the dispensing closure.
Figure 5:
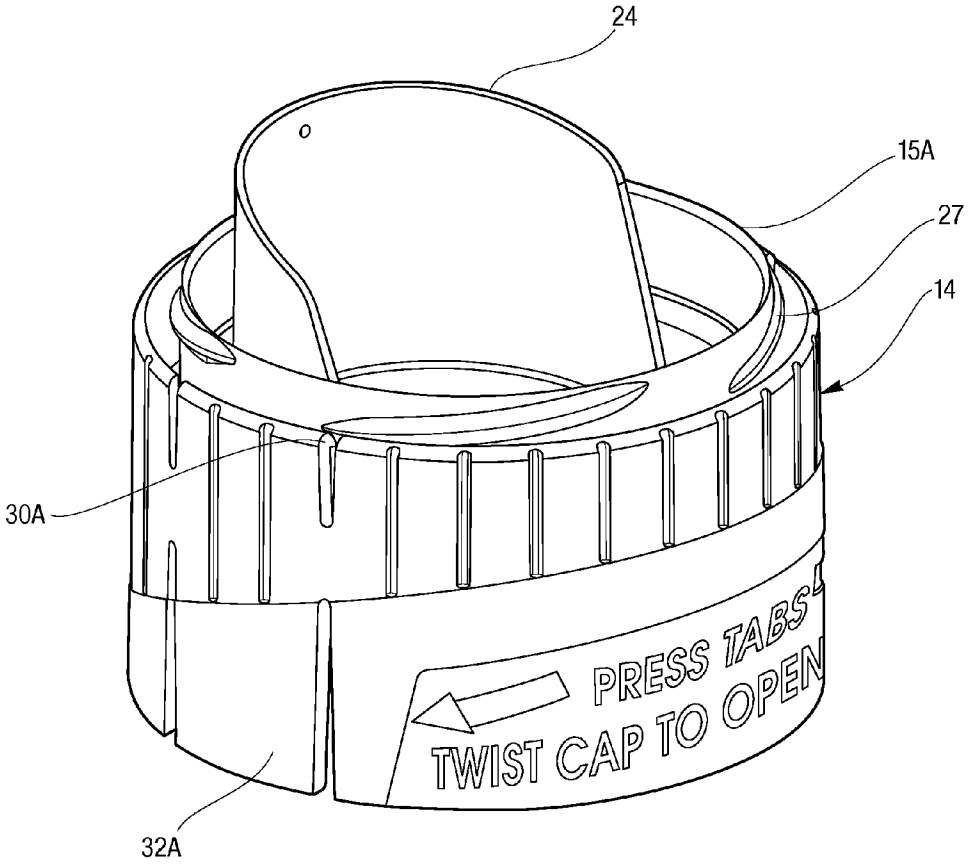
FIG. 5 is a top view of the cup base of the dispensing closure.
Figure 6:
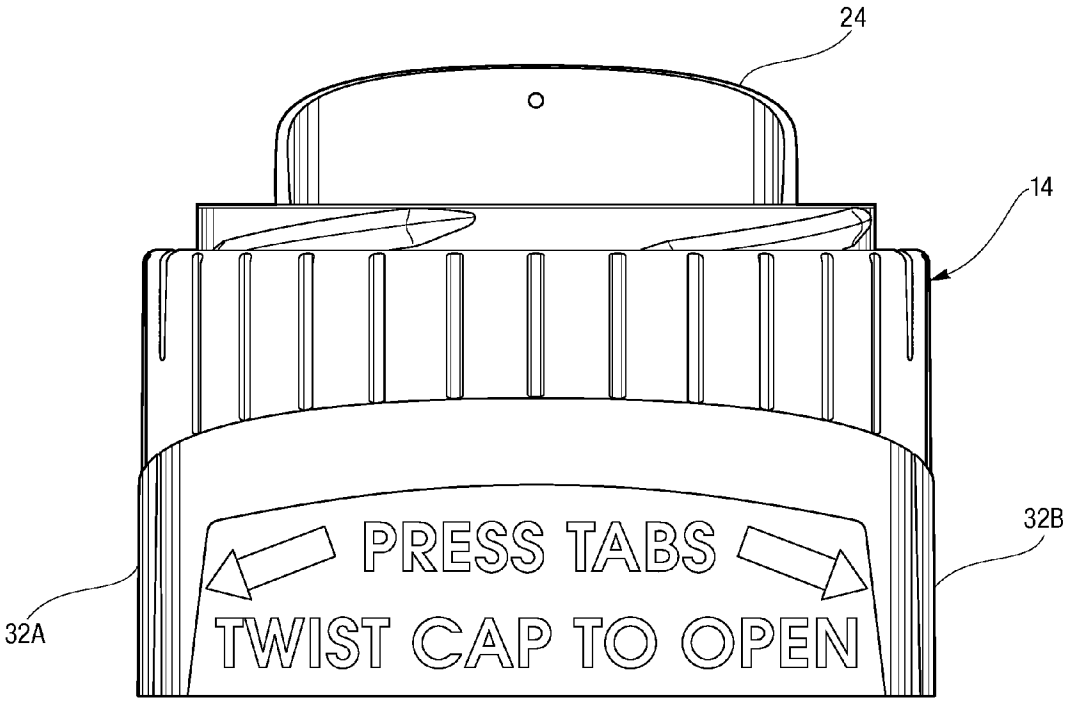
FIG. 6 is side view of the cup base of the dispensing closure.
Figure 7:
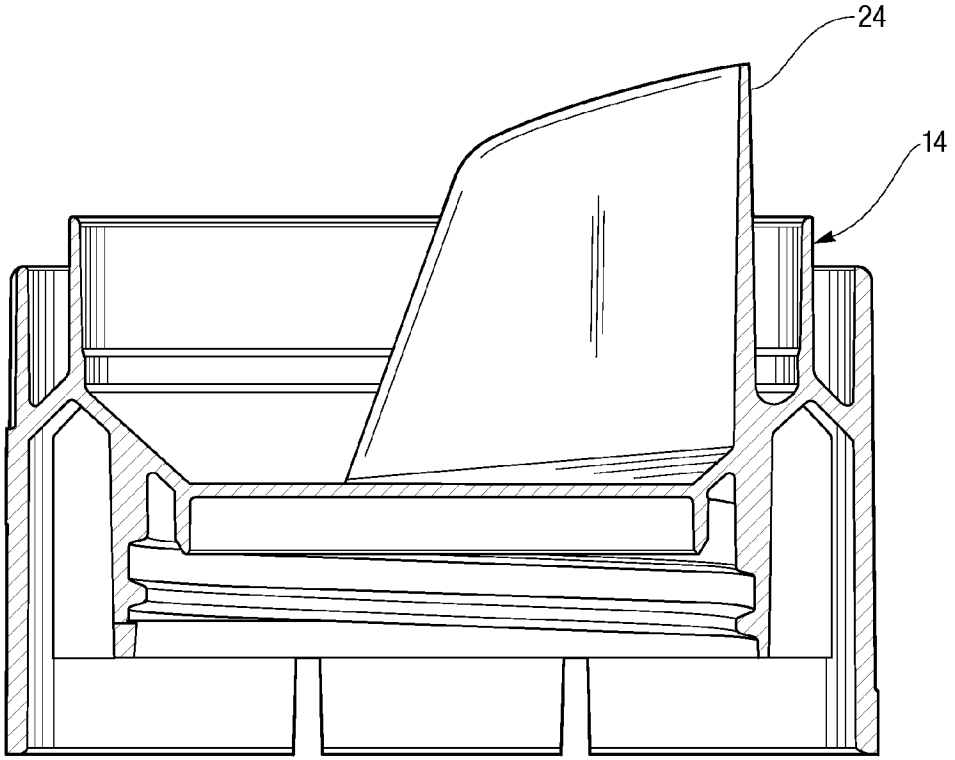
FIG. 7 is a front cross-sectional view of the cup base of the dispensing closure.
Figure 8:
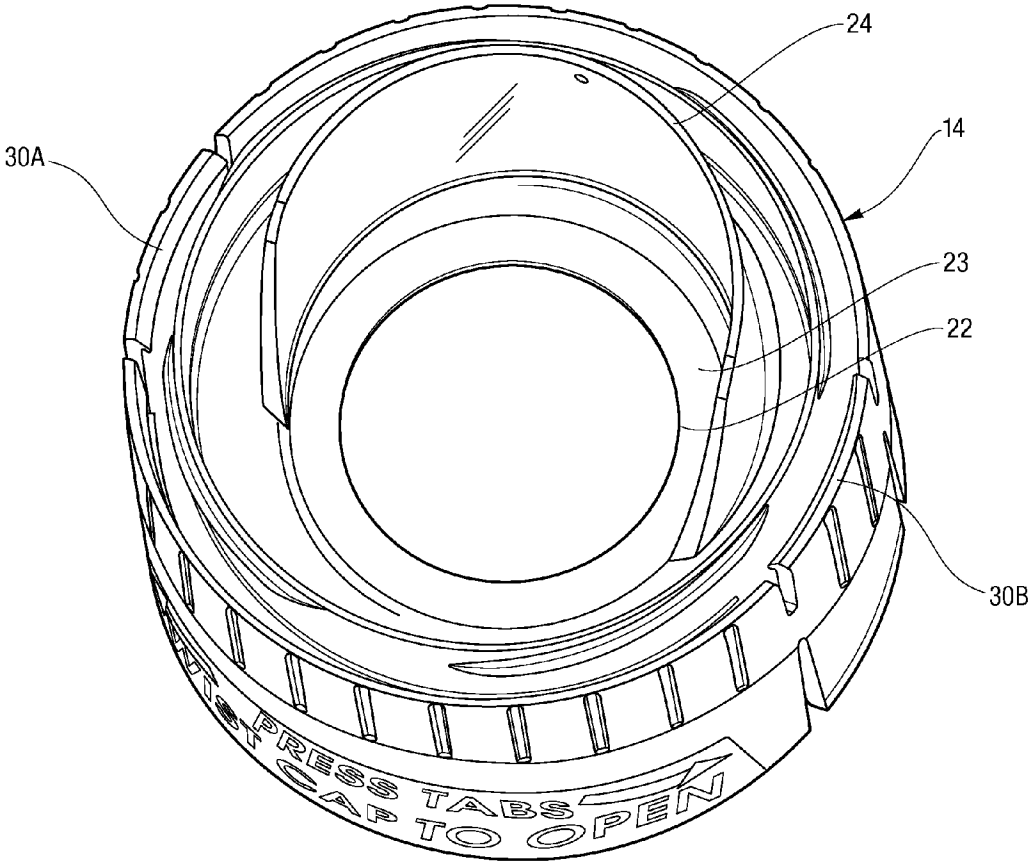
FIG. 8 is a left perspective view of the cup base of the dispensing closure.
Figure 19:
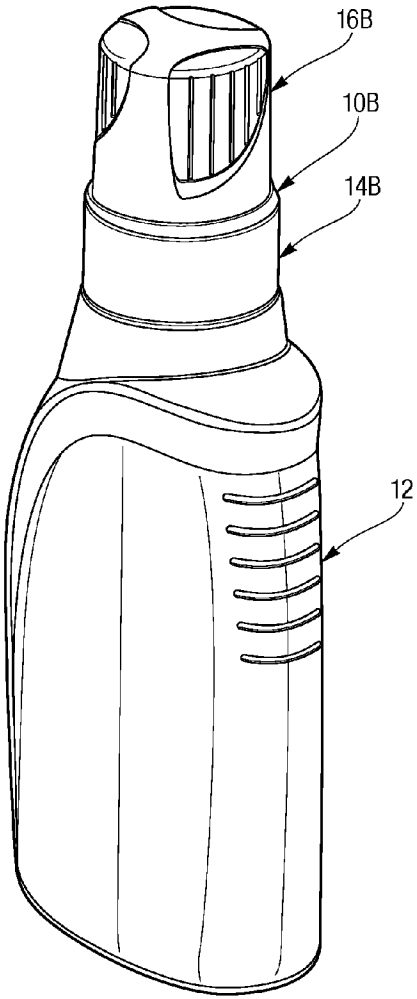
FIG. 19 is perspective view of another exemplary embodiment of the dispensing closure attached to a product container.

Referring now to the drawings, a first exemplary embodiment is illustrated and generally indicated at 10 in FIGS. 1-3. As will hereafter be more fully described, a first exemplary embodiment of a dispensing closure 10 in accordance with the teachings herein is operable for dispensing a product from a container 12 (FIG. 19). For purposes of the present disclosure, the product, in one embodiment, may be a liquid product, such as weed killer.

The dispensing closure 10 is a two-piece dispensing closure 10 which includes a cup base 14 and a measuring cup 16. In one embodiment, the dispensing closure 10 is made of plastic material but may be made of any other suitable materials for dispensing a product.

Referring to FIGS. 4-10, the cup base 14 has an inner skirt 15, an outer skirt 18 and a deck 20. The deck 20 defines a dispensing aperture 22 (FIG. 22) to allow a flow of product from the container 12. In one embodiment, a spout 24 or pour spout surrounds an outer profile of the dispensing aperture 22 and depends from the deck 20. The spout 24 may be integrally formed with the deck 20. The spout 24 has a diameter which is greater than the diameter of the dispensing aperture 22.

The inner skirt 15 depends from the deck 20 and has an upper portion 15A and a lower portion 15B. The lower portion 15B of the inner skirt 16 is configured and arranged to engage a neck 28 of the container 12. In one embodiment, the lower portion 15B of the inner skirt 15 has at least one or more threads 26 extending inwardly for threadably engaging one or more threads 30 on the neck 28 (FIG. 16, 17A-D) of the container 12. Alternatively, the cup base 14 may be snap fit or other means may be used for attaching the cup base 14 to the neck 28 of the container 12.

The upper portion 15A of the inner skirt 15 is configured and arranged to engage a measuring cup 16. In one embodiment, the upper portion 15A of the inner skirt 15 has at least one or more threads 27 for threadably engaging the measuring cup 16. In one embodiment, the upper portion 15A of the inner skirt 15 has a four start thread lead or less.

The outer skirt 18 depends from the deck 20 and has an upper portion 18A and a lower portion 18B. The upper portion 18A of the outer skirt 18 has at least one or more latch hook members 30A, 30B to engage the measuring cup 16. The lower portion 18B of the outer skirt 18 has at least one or more latch hook areas 32A, 32B configured to disengage the at least one or more latch hook members 30A, 30B from the measuring cup 16 upon application of force to the one or more latch hook areas 32A, 32B. In one embodiment, both latch hook areas are squeezed simultaneously to disengage the latch hook areas.

In one embodiment, an inner conduit ring 34 depends downwardly from the deck 20 to provide a flow conduit. The inner conduit ring 34 may surround an outer diameter of the dispensing aperture 22 to facilitate the dispensing of product from the container 12.

Figure 9:
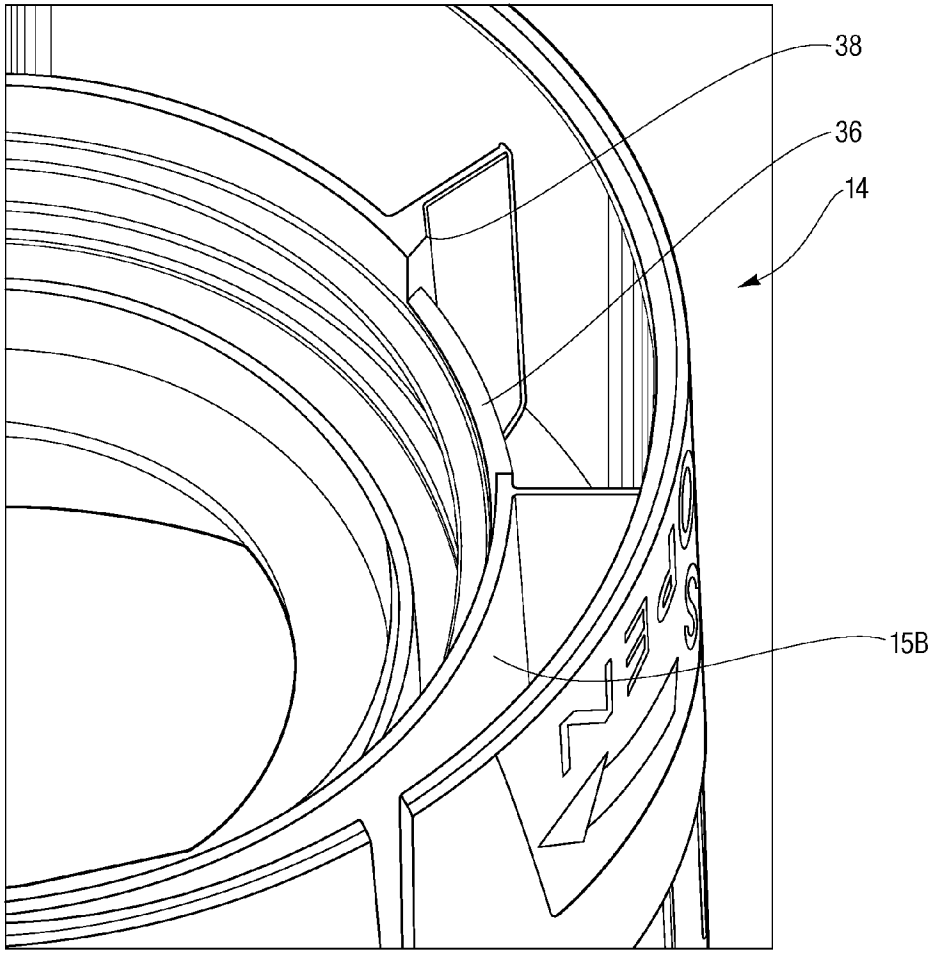
FIG. 9 is a partial bottom perspective view of the cup base of the dispensing closure.
Figure 10:
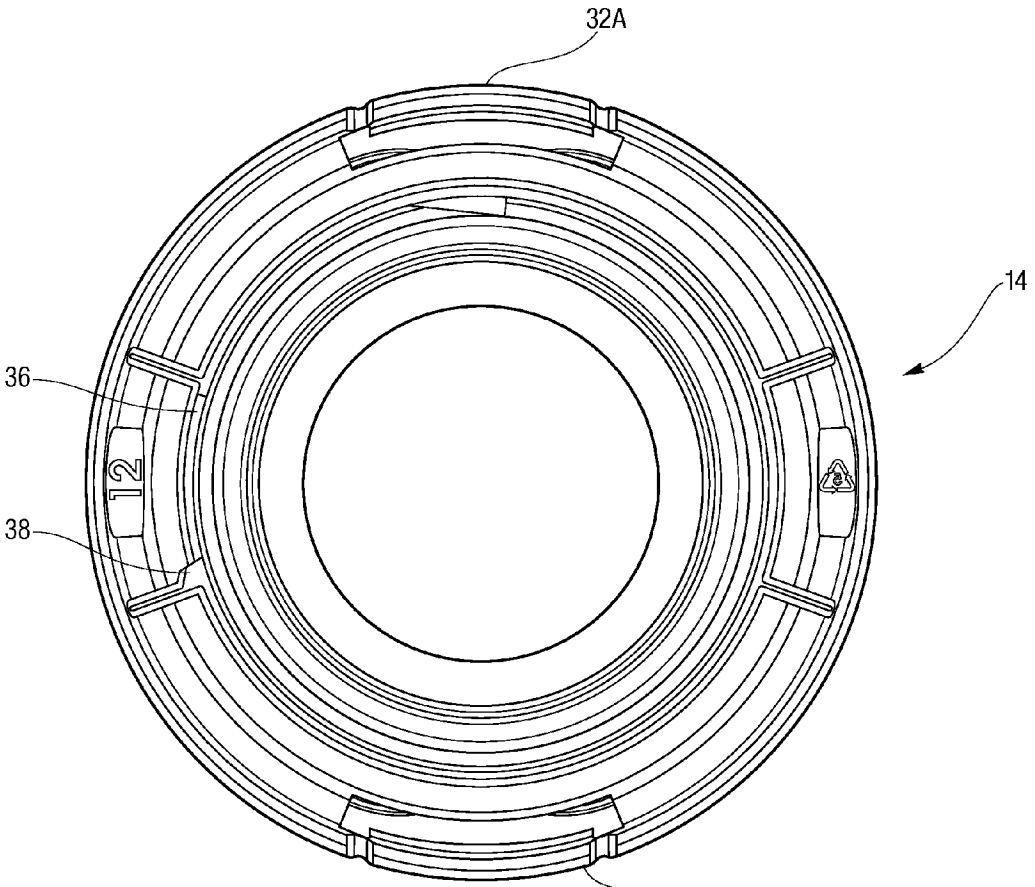
FIG. 10 is a bottom view of the cup base of the dispensing closure.
Figure 11:
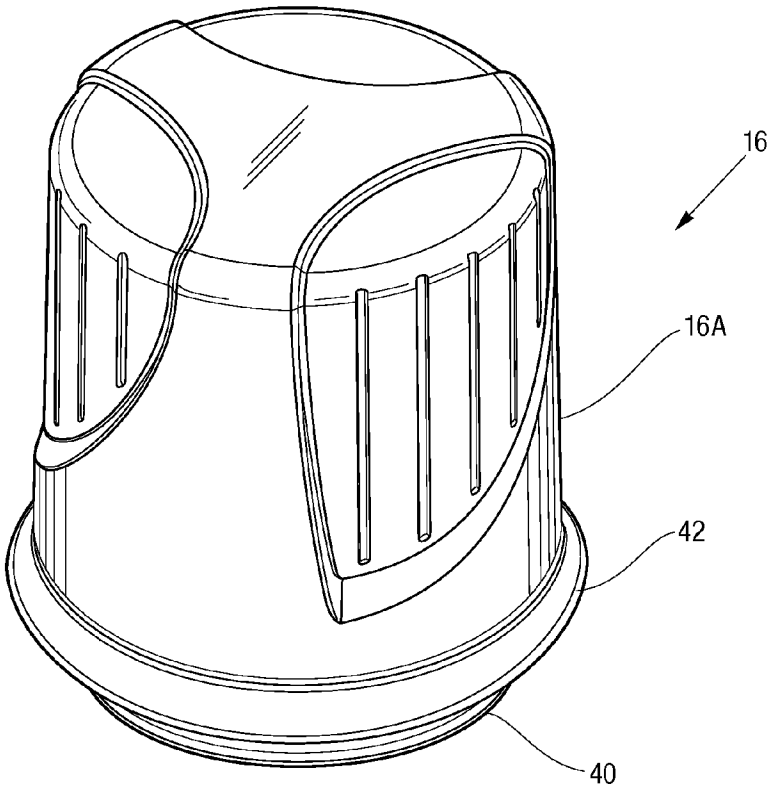
FIG. 11 is an isometric view of the measuring cup of the dispensing closure.
Figure 12:
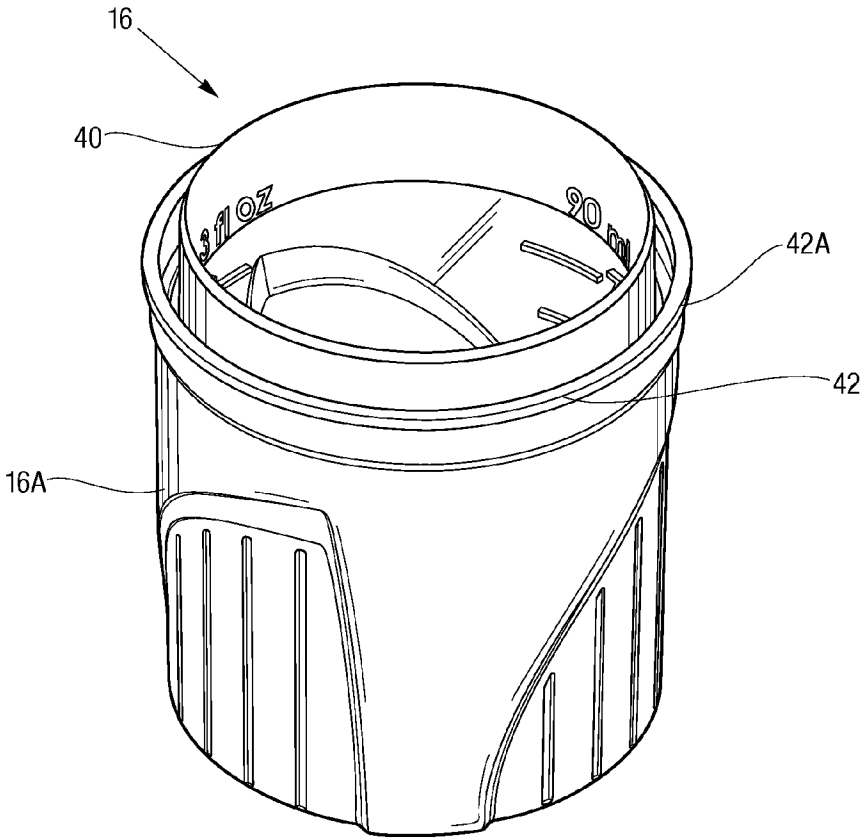
FIG. 12 is an elevated view of the measuring cup of the dispensing closure.
Figure 13:
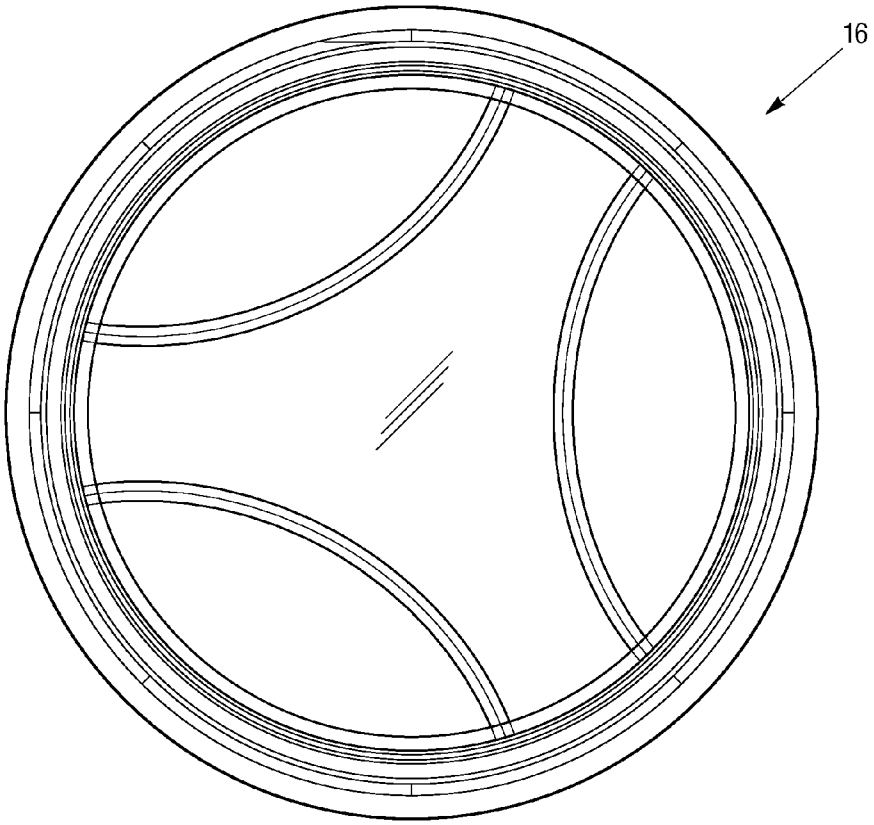
FIG. 13 is a bottom view of the measuring cup of the dispensing closure.
Figure 14:
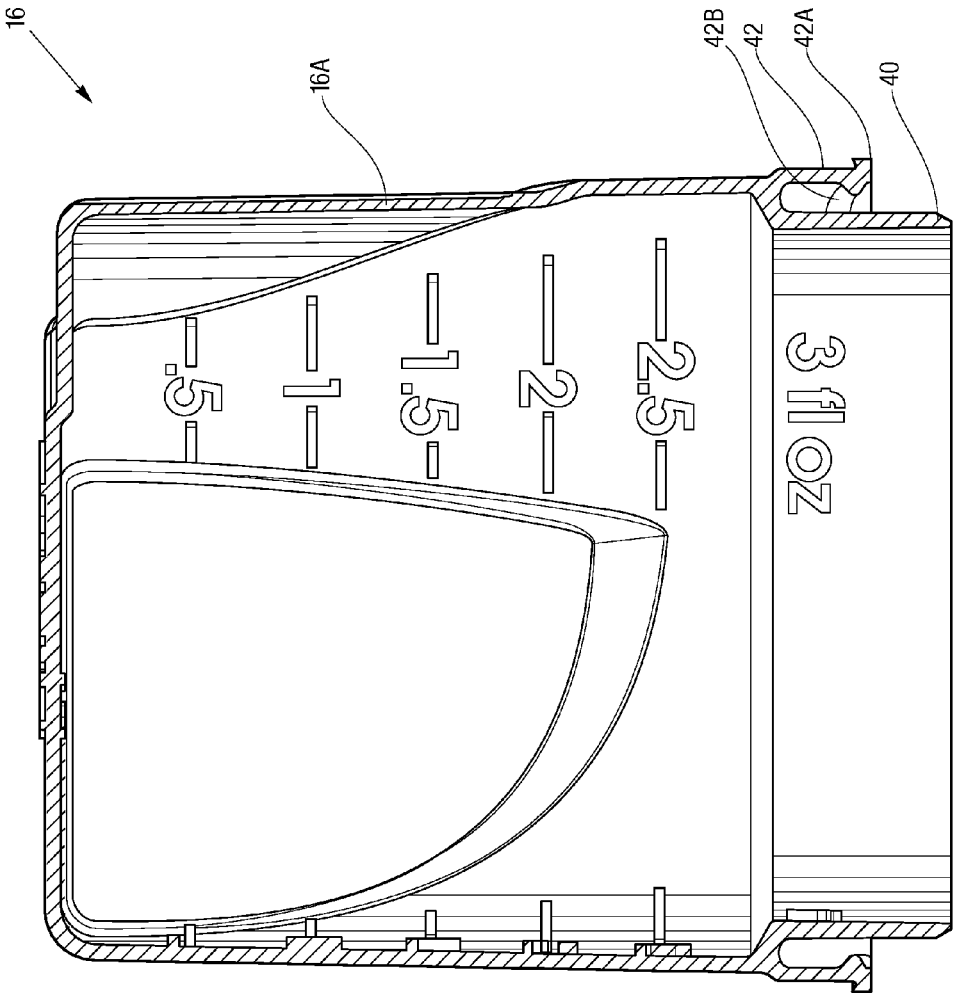
FIG. 14 is a cross-sectional view of the measuring cup of the dispensing closure.
Figure 15:
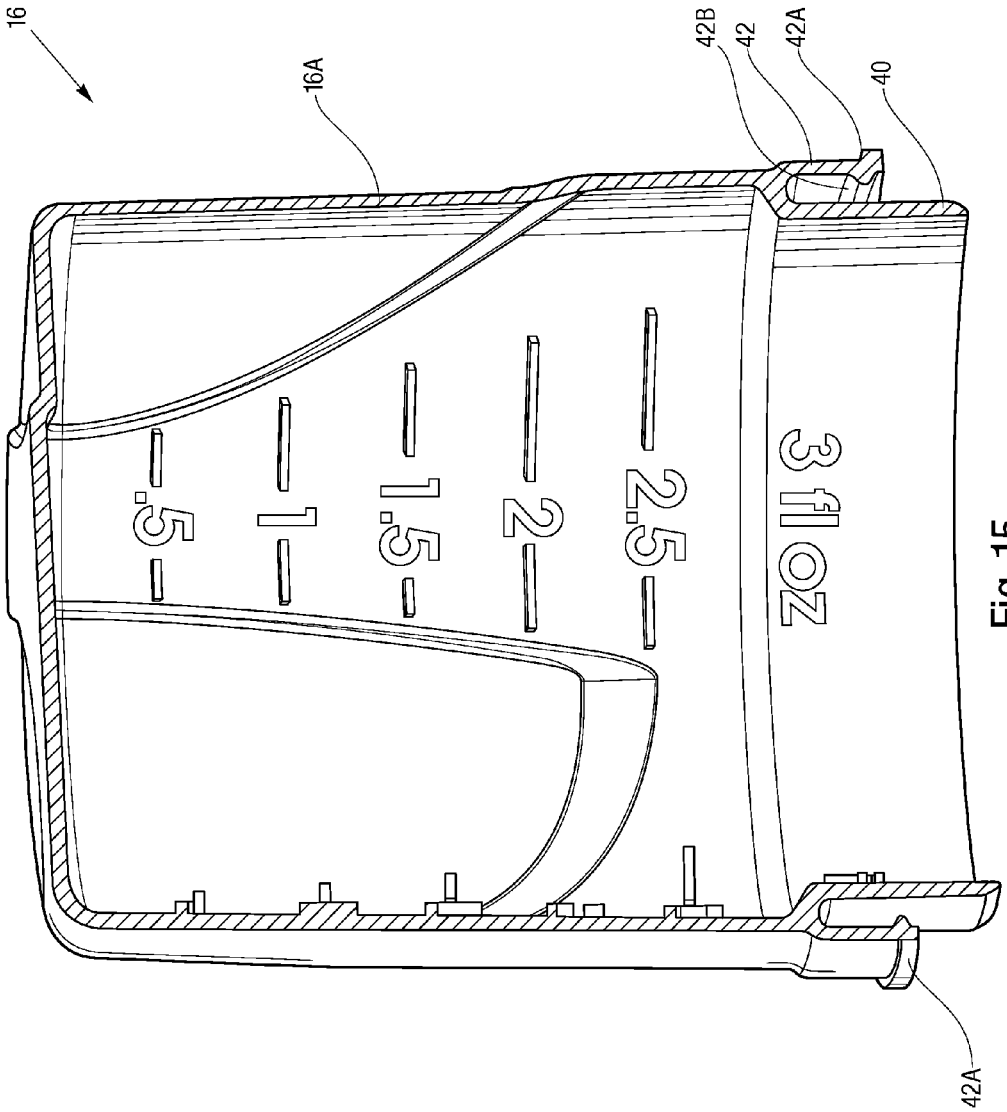
FIG. 15 is another cross-sectional view of the measuring cup of the dispensing closure.
Figure 16:
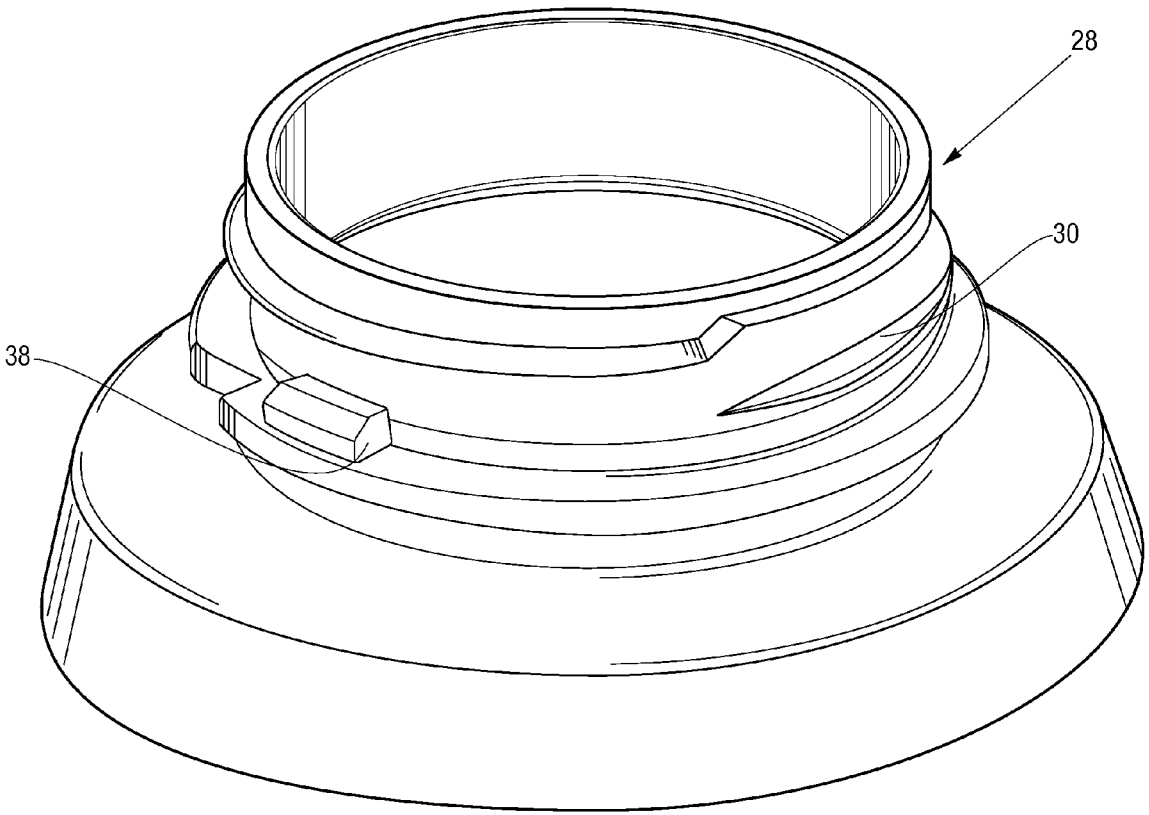
FIG. 16 is a perspective view of a first exemplary embodiment of a neck of a product container configured for attachment to the dispensing closure.
Figure 17A:
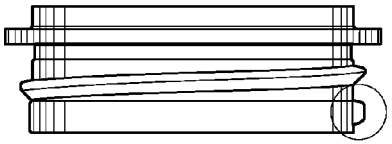
FIGS. 17A-17D are views of another exemplary embodiment of a neck of a product container configured for attachment to the dispensing closure.
Figure 17B:
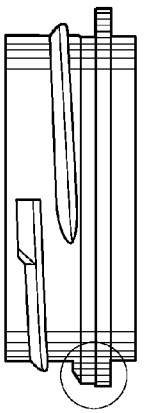
Figure 17C:
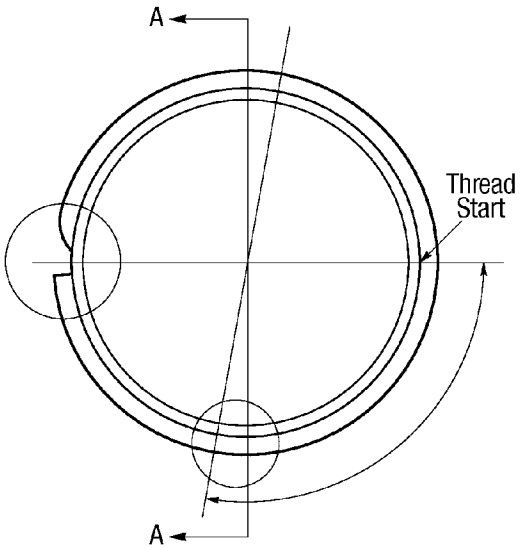
Figure 17D:
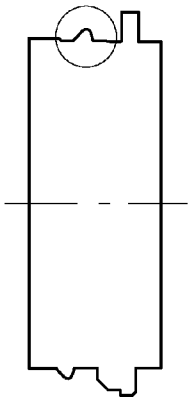

Referring to FIGS. 9-10, a self-alignment feature is provided to properly orient the cup base 14 on the neck 28 of the container 12. The lower portion 15B of the inner skirt 15 defines a cut-out 36 for engaging an orientation lug 38 on the neck 28 of the container 12 to facilitate proper orientation of the cup base 14 to the product container 12. Upon rotation of the cup base 14 onto the neck, the cut-out 36 in the inner skirt 15 engages the orientation lug 38 on the neck 28 to orient or align the pour spout 24 to the front of the container 12 in a consistent position for convenience of display and usage. It should be noted that the cut-out 36 may be defined along the inner skirt 15 to adjust the position of the pour spout 24 relative to the container 12 as desired.

The lower portion 15B of the inner skirt 15 further has a thread stop 38 or anti-rotation lug located proximal to the cut-out 36 to prevent removal of the cup base 14 from the neck 28 of the container 12 after the cup base 14 is threadably attached to the neck 28 of the container 12.

Referring to FIGS. 11-15, the measuring cup 16 is shown and illustrated. The measuring cup 16 has an overall profile with a stepped inner diameter as shall be explained further below. The measuring cup 16 includes a measuring cup body 16A, an inner measuring cup skirt 40, and an outer measuring cup skirt 42. In one embodiment, the measuring cup body 16A has measuring indicia, indicated in fluid ounces and milliliters, located on an inner surface to facilitate measuring of product. The measuring cup 16 may be made of plastic materials, such as clear plastic materials.

The dispensing closure 10 has one or more CR (child-resistant) features. In one embodiment, an outer surface of the outer measuring cup skirt 42 has a stepped shoulder 42A for engaging the at least one or more latch hook members 30A, 30B of the cup base 14. For example, the stepped shoulder 42A of the measuring cup 16 snaps under opposing 180 degree latch hook members 30A, 30B on the cup base 14 to prevent removal of the measuring cup 16 from the cup base 14. In order to release the measuring cup 16 from the cup base 14, a force is applied by a user to squeeze the latch hook areas 32A, 32B under the latch hook members 30A, 30B to release the latch hook members 30A, 30B and thereby removing the measuring cup 16 from the cup base 14. Of course, this is by way of example and the degrees of separation of the latch hook members, number of latch hook members and latch hook areas may vary and be adjusted as necessary.

In one embodiment, the measuring cup 16 is threadably attached to the cup base 14. An inner surface of the outer measuring cup skirt 42 having one or more threads 42B extending inwardly for engaging the one or more threads 27 of the upper portion 15A of the inner skirt 15 of the cup base 14. Of course, it is contemplated that other methods of engaging the measuring cup 16 and cup base 14 may be used, such as friction or snap fit.

Figure 18:
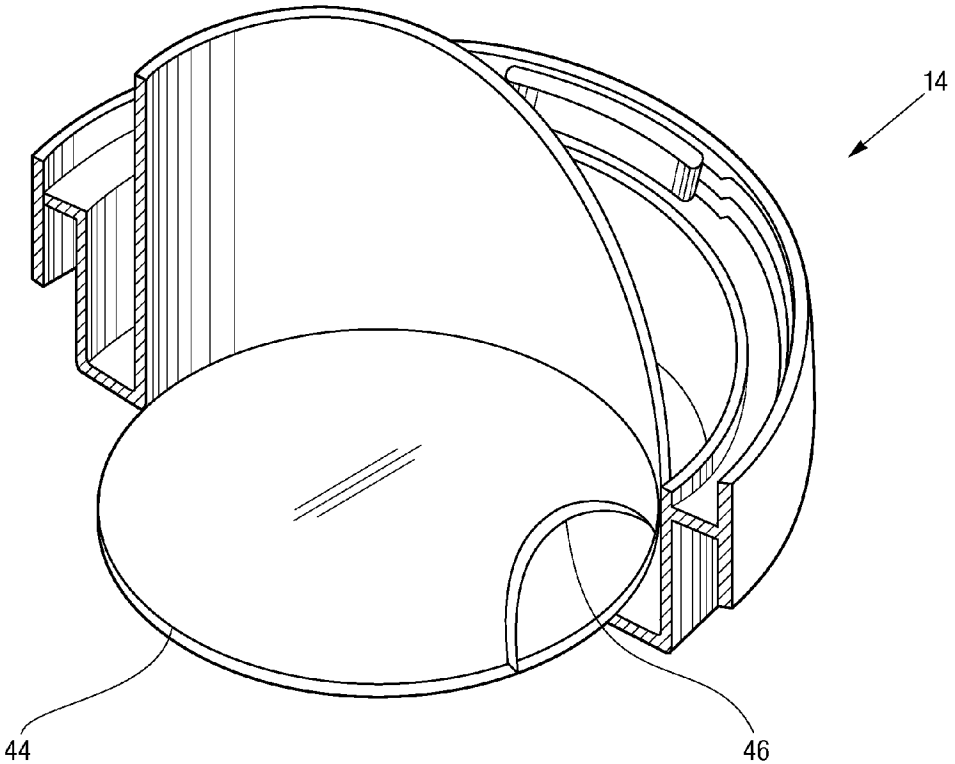
FIG. 18 is a partial cross-sectional view of an exemplary embodiment cup base having a liner.

Referring to FIG. 18, a liner 44 may be disposed proximal to the dispensing aperture 22. In one embodiment, the liner 44 may be removably attached proximal to the dispensing aperture 22. The liner may also be attached to a liner shelf 23 (FIG. 8) or bead positioned on an inner diameter of the spout 24. It should be noted that a conduction liner or other type of liner with a pull tab 46 may be disposed on the liner shelf 23 on the inner diameter of the pour spout 24 of the cup base 14.

The dispensing closure 10, in one embodiment, has a distance between the inner skirt 15 and the outer skirt 18 of the cup base 14 which is configured to receive the outer measuring cup skirt 42 of the measuring cup 16. In another embodiment, a diameter of the inner measuring cup skirt 40 is less than the diameter of the inner skirt 15 of the cup base 14. Also, the diameter of the outer measuring cup skirt 42 is less than the diameter of the outer skirt 18 of the cup base 14.

The dispensing closure 10 includes a combination of both "squeeze and turn" CR features and threadably removing the measuring cup 16 from the cup base 14. In operation, in order for a user to disengage the CR feature of measuring cup 16 and the cup base 14, the user must squeeze latch hook areas 32A, 32B of the cup base 14 under the latch hook members 30A, 30B to disengage the latch hook members 30A, 30B from the stepped shoulder 42A of the outer measuring cup skirt 42. Thereafter, after the disengagement of the CR feature, the measuring cup 16 is permitted to be threadably removed from the cup base 14.

While there is shown and described herein certain specific structure of the exemplary embodiments, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A dispensing closure for dispensing a product from a container, said dispensing closure comprising:

a cup base comprising an inner skirt, an outer skirt and a deck, the deck defining a dispensing aperture to allow a flow of product from the container, the inner skirt of the cup base depending from the deck, the inner skirt of the cup base having an upper portion and a lower portion, the lower portion configured and arranged to engage a neck of the container, the upper portion configured and arranged to engage a measuring cup, the outer skirt of the cup base depending from the deck, the outer skirt of the cup base having an upper portion and a lower portion, the upper portion of the outer skirt having at least one or more latch hook members to engage the measuring cup, the lower portion of the outer skirt having at least one or more latch hook areas configured to disengage the at least one or more latch hook members from the measuring cup upon application of force to the one or more latch hook areas; and the measuring cup comprising a measuring cup body, an inner measuring cup skirt, and an outer measuring cup skirt, an outer surface of the outer measuring cup skirt having a stepped shoulder for engaging the at least one or more latch hook members of the cup base.

2. The dispensing closure of claim 1, wherein the product dispensed from the container is a liquid product.

3. The dispensing closure of claim 1, wherein the lower portion of the inner skirt of the cup base has at least one or more threads extending inwardly for threadably engaging one or more threads on a neck of the container.

4. The dispensing closure of claim 1, wherein the lower portion of the inner skirt defines a cutout within the inner skirt for engaging an orientation lug on the neck of the container to facilitate orientation of the cup base to the product container.

5. The dispensing closure of claim 4, further comprising:

the lower portion of the inner skirt having a thread stop lug located proximal to the cutout.

6. The dispensing closure of claim 1, wherein an inner surface of the outer measuring cup skirt having one or more threads extending inwardly.

7. The dispensing closure of claim 6, wherein the upper portion of the inner skirt has at least one or more threads for threadably engaging the one or more threads of the inner surface of the outer measuring cup skirt.

8. The dispensing closure of claim 1, wherein a distance between the inner skirt and the outer skirt of the cup base is configured to receive the outer measuring cup skirt of the measuring cup.

9. The dispensing closure of claim 1, wherein a diameter of the inner measuring cup skirt is less than the diameter of the inner skit of the cup base.

10. The dispensing closure of claim 1, wherein the diameter of the outer measuring cup skirt is less than the diameter of the outer skirt of the cup base.

11. The dispensing closure of claim 1, further comprising:

a spout surrounding the dispensing aperture and depending from the deck.

12. The dispensing closure of claim 10, further comprising:

a liner member removably attached proximal to the dispensing aperture.

13. The dispensing closure of claim 11, wherein the liner member is attached to a liner shelf positioned on an inner diameter of the spout.

14. The dispensing closure of claim 1, wherein the measuring cup body has indicia located on an inner surface to facilitate measuring of product.

15. The dispensing closure of claim 1, wherein the measuring cup has a stepped inner diameter.

* * * * *